US008146326B2

(12) United States Patent
McMullen et al.

(10) Patent No.: US 8,146,326 B2
(45) Date of Patent: Apr. 3, 2012

(54) LIGHT WEIGHT LOAD BEARING ARCHITECTURAL COLUMN

(75) Inventors: Brian K. McMullen, Waxhaw, NC (US); Dale R. Fuchs, Indian Trail, NC (US)

(73) Assignee: Sturdicorp, LLC, Monroe, NC (US)

( * ) Notice: Subject to any disclaimer, the term of this patent is extended or adjusted under 35 U.S.C. 154(b) by 0 days.

(21) Appl. No.: 13/231,708

(22) Filed: Sep. 13, 2011

(65) Prior Publication Data

US 2012/0000154 A1 Jan. 5, 2012

Related U.S. Application Data

(62) Division of application No. 11/858,229, filed on Sep. 20, 2007, now Pat. No. 8,015,775.

(51) Int. Cl.

| | |
|---|---|
| ***E04H 12/22*** | (2006.01) |
| ***E04C 3/30*** | (2006.01) |
| *E04H 12/02* | (2006.01) |
| *E04C 3/32* | (2006.01) |

(52) U.S. Cl. ..... 52/834; 52/170; 52/309.16; 52/845

(58) Field of Classification Search ..... 52/169.6, 52/170, 292, 293.1, 293.3, 296, 298, 299, 52/309.1, 309.7, 309.16, 834, 835, 843, 844, 52/845; 248/200, 205.1, 218.4, 219.2, 200.21
See application file for complete search history.

(56) References Cited

U.S. PATENT DOCUMENTS

| | | | | |
|---|---|---|---|---|
| 849,951 A | | 4/1907 | White | |
| 950,806 A | | 3/1910 | Richardson | |
| 969,097 A | | 8/1910 | Ford | |
| 973,615 A | | 10/1910 | Barrick | |
| 1,350,686 A | | 8/1920 | Trudelle | |
| 1,934,260 A | | 11/1933 | Dean | |
| 2,733,785 A | * | 2/1956 | Beatty | 52/239 |
| 3,135,363 A | * | 6/1964 | Bourassa | 52/296 |
| 3,282,001 A | * | 11/1966 | Bigalow | 52/292 |
| 3,324,613 A | | 6/1967 | Duboff | |
| 3,421,269 A | | 1/1969 | Medow | |
| 3,698,564 A | | 10/1972 | Muller | |
| 3,764,642 A | | 10/1973 | Boutillier | |
| 3,842,557 A | | 10/1974 | Brown | |
| 3,945,741 A | | 3/1976 | Wendt | |
| 4,048,776 A | | 9/1977 | Sato | |
| 4,070,837 A | | 1/1978 | Sato | |
| 4,074,811 A | * | 2/1978 | Filak | 211/191 |
| 4,104,000 A | | 8/1978 | Fleishmann | |
| 4,125,217 A | | 11/1978 | Sato | |

(Continued)

FOREIGN PATENT DOCUMENTS

EP 39614 A2 * 11/1981

*Primary Examiner* — Brian Glessner
*Assistant Examiner* — Joseph J Sadlon
(74) *Attorney, Agent, or Firm* — Summa, Additon & Ashe, P.A.

(57) ABSTRACT

A tapered lightweight load bearing architectural column is disclosed. The column includes an exterior shell formed of a plurality of walls that together define an open interior and defining a tapered cross section from one end to another end. An interior load bearing shaft is within the exterior shell and is proportionally smaller than the exterior shell. One portion of the interior load bearing shaft is connected against one interior wall of the exterior shell with the remaining portions of the interior shaft being independent of the other interior walls of the interior shell.

16 Claims, 2 Drawing Sheets

U.S. PATENT DOCUMENTS 4,216,634 A 8/1980 Binder
4,353,411 A * 10/1982 Harter et al. ..... 165/48.1
4,383,812 A 5/1983 Calcagni
4,587,893 A 5/1986 Brockhaus et al.
4,589,332 A 5/1986 Brockhaus et al.
4,641,467 A 2/1987 Dupuis, Jr.
4,684,097 A 8/1987 Cox
4,738,061 A * 4/1988 Herndon ..... 52/126.6
4,841,708 A * 6/1989 Johnston ..... 52/646
4,899,497 A * 2/1990 Madl, Jr. ..... 52/126.6
5,063,719 A 11/1991 Matsuo et al.
5,342,138 A * 8/1994 Saito et al. ..... 403/189
5,605,023 A 2/1997 Biernazki
5,617,697 A 4/1997 Erwin
5,660,013 A * 8/1997 Saldarelli et al. ..... 52/296
5,671,580 A 9/1997 Chou
5,692,351 A 12/1997 Morrison, III et al.
5,794,395 A 8/1998 Reed
5,862,642 A 1/1999 Erwin
5,873,671 A * 2/1999 West ..... 403/232.1
5,901,525 A 5/1999 Doeringer et al.
5,934,035 A 8/1999 Rasmussen et al.
6,003,277 A 12/1999 Graham et al.
6,065,268 A 5/2000 Gump
6,141,928 A * 11/2000 Platt ..... 52/296
6,176,053 B1 1/2001 St. Germain
6,305,670 B1 10/2001 Ward et al.
6,467,756 B1 10/2002 Elasser
6,579,481 B2 6/2003 Auman
6,640,517 B2 * 11/2003 Mitchell ..... 52/298
6,874,766 B2 4/2005 Curatolo
6,898,882 B2 * 5/2005 Kim ..... 40/607.1
6,908,577 B2 6/2005 Auman
7,219,873 B2 * 5/2007 Harwood ..... 248/519
7,243,473 B2 7/2007 Terrels
7,470,091 B2 12/2008 Scholl
7,543,802 B2 6/2009 Petta et al.
7,726,091 B2 6/2010 Frohlich et al.
7,762,016 B2 7/2010 Davidson
2002/0116893 A1 8/2002 Waldrop
2003/0101679 A1 6/2003 Erwin
2007/0234662 A1 10/2007 Hanig et al.

* cited by examiner

LIGHT WEIGHT LOAD BEARING ARCHITECTURAL COLUMN

CROSS REFERENCE TO RELATED APPLICATIONS

This Application claims priority as a divisional of U.S. patent application Ser. No. 11/858,229, now U.S. Pat. No. 8,015,775, filed on Sep. 20, 2007, the disclosure of which is incorporated by reference in its entirety as if set forth fully herein.

BACKGROUND

The present invention relates to load bearing architectural columns and related structures of the type often used in residential (and similar) construction.

The use of columns as supporting structural elements is common throughout history with the most notable and classic styles having been developed in ancient Greece and Rome.

The aesthetic appeal of columns, combined with their structural advantages, makes them a favorite architectural element in residential housing and related structures.

Historically, of course, columns were made of stone or other heavy materials. Indeed, many structures continue to use columns of this type. Although such column materials are structurally sound, in less-demanding applications such as residential construction they can be somewhat impractical.

More recent developments include decorative columns formed from materials such as extruded aluminum formed into hollow columns with sidewalls that support compression loads along the axis of the column. These are, however, still relatively heavy making the columns difficult to transport, manipulate, and fix in a structure. Because the columns are hollow, they have some aesthetically undesirable characteristics such as rattling and offering a hollow sound when struck.

As an alternative, ornamental columns and arch structures for residential and similar structures have been custom fabricated from wood Other pre-fabricated columns are formed from fiberglass-reinforced plastics. Others are formed from fiber structures with resin infusion. Other columns are made using continuous filament winding processes.

For reasons of cost and availability, the structural (weight-bearing) functions of many residential columns are based upon a four inch by four inch ("4×4") treated wood post surrounded by a decorative column exterior. Although the appearance of such treated posts is generally aesthetically unacceptable (with the exception of decking and related structures) they have the advantage of relatively low cost and wide ranging availability. Adding the column exterior provides the desired appearance.

Treated wood posts nevertheless are relatively heavy. Being formed of wood, they will almost invariably twist, bow and warp in use. Additionally, the natural expansion and contraction of wood based upon temperature and humidity conditions causes problems in keeping the post adhered to the remainder of the column. Wooden structures are also susceptible to attack from termites, carpenter ants, and fungi.

As a result, if the decorative portion of the column is attached directly to the treated post, the warping and twisting of the treated post will damage the decorative exterior. Thus, the treated post and decorative shell should be spaced from one another. Additionally, the chemical compositions used to treat the wood against rotting or other decomposition tend to bleed from the post and onto the surrounding structure. The wood-preservative compositions can also tend to accelerate the oxidation of metals, and thus can adversely affect any nails, screws or other fasteners used in or near the column.

As another problem, in a post and shell structure the treated post needs to be centered within the decorative portion of the column and avoid touching the PVC shell. As a result, the post's location is often determined by the desired position of the decorative exterior of the column rather than the structural requirements of the end use.

As yet another problem, a 4×4 treated post is typically put into position by being glued to a concrete pad at the bottom and then being toe nailed to the cross beam at the top. A toe-nail is, however, a relatively weak fastening technique. Toe-nailing tends to split and weaken the wood. Toe-nailing is also less exact than other types of connections and will in time to allow the column to shift. Because of the angle of the screw or nail, maximum holding strength cannot be achieved. This is less than desirable from a structural standpoint even if consistent with building codes. Over time, the glued and toe-nailed structure will eventually crack and fail.

Additionally, the fibers nature of wood allows water to wick up from the bottom of the post eventually causing structural failure.

SUMMARY

In one aspect the invention is a lightweight load bearing architectural column comprising an exterior shell formed of a plurality of walls that together define an open interior. An interior load bearing shaft is within the exterior shell and is proportionally smaller than the exterior shell. One portion of the interior shaft is connected against one interior wall of the exterior shell with the remaining portions of the interior shaft being independent of the other interior walls of the interior shell.

In another aspect, the invention is an architectural structure that includes a generally horizontal floor and a generally horizontal beam above and spaced apart from the horizontal floor. A vertically oriented load bearing shaft is between the floor and the beam for supporting the beam through the shaft and on the horizontal floor. The structure also includes an exterior shell formed of a plurality of walls that together define an open interior with one portion of the interior shaft being connected against one interior wall of the exterior shell with the remaining portions of the interior shaft being independent of the other interior walls of the interior shell.

In another aspect, the invention is a decorative architectural column that includes a tapered exterior decorative polymer column shell formed of a plurality of contiguous walls that together define a base having a first area at one common end of the walls and a capital having a second area at the opposite end of the walls. The capital area is smaller than the base area so that the difference in size between the area of the base and the area of the capital produces a taper longitudinally along the column. An interior load bearing shaft is surrounded by the decorative polymer column and spaced from the tapering walls so that the load bearing shaft and the exterior shell avoid touching one another. A fixture is positioned at the base of the column and on the interior of the shell and connects to at least one, but less than all, of the contiguous walls and also connects to the shaft.

In yet another aspect the invention is an architectural structure that includes a generally horizontal floor and a generally horizontal beam above and spaced apart from the horizontal floor. A vertically oriented load bearing shaft is between the base and the beam for supporting the beam through the shaft and on the horizontal floor. The structure includes a tapered exterior decorative polymer column shell formed of a plurality of contiguous walls that together define a base having a first area at one common end of the walls and a capital having a second area at the opposite end of the walls and with the capital area being smaller than the base area so that the difference in size between the area of the base and the area of the capital produces a taper longitudinally along the column. A fixture is positioned at the base of the column and on the interior of the column and connects to at least one, but less than all, of the contiguous walls and also connects to the metal shaft.

The foregoing and other objects and advantages of the invention and the manner in which the same are accomplished will become clearer based on the followed detailed description taken in conjunction with the accompanying drawings.

DETAILED DESCRIPTION

Figure 1:
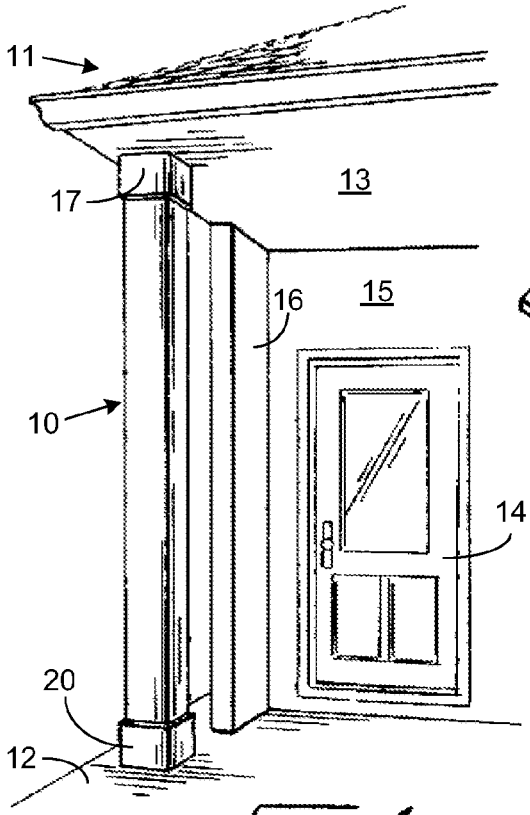
FIG. 1 is a perspective view of one embodiment of a column and structure according to the present invention.

FIG. 1 is a perspective view of a column broadly designated at 10 according to the present invention in the context of an architectural structure that includes (by way of example and not limitation) a roof broadly designated at, 11 a floor 12 and a ceiling 13 above the floor 12. It will be understood that although a floor 12 and a ceiling 13 are named and illustrated, the column 10 can be positioned between related equivalent structures including (but not limited to) ceiling or floor beams, joists or trusses. FIG. 1 illustrates a residential-type entry that includes the door 14 and adjacent walls 15 and 16. The column 10 includes a capital 17 and a base 20 features of which will be discussed with respect to FIG. 3. For purposes of illustration, and clarity, the base 20 and capital 17 are illustrated as simple geometric structures, but it will be understood that they can be selected with more ornate designs while still falling within the context of the invention. It will be understood that although the term "column" is often used to refer to round pillars, it will be used in a broader sense herein to include other cross-sections, including (but not limited to) squares and rectangles.

Figure 3:
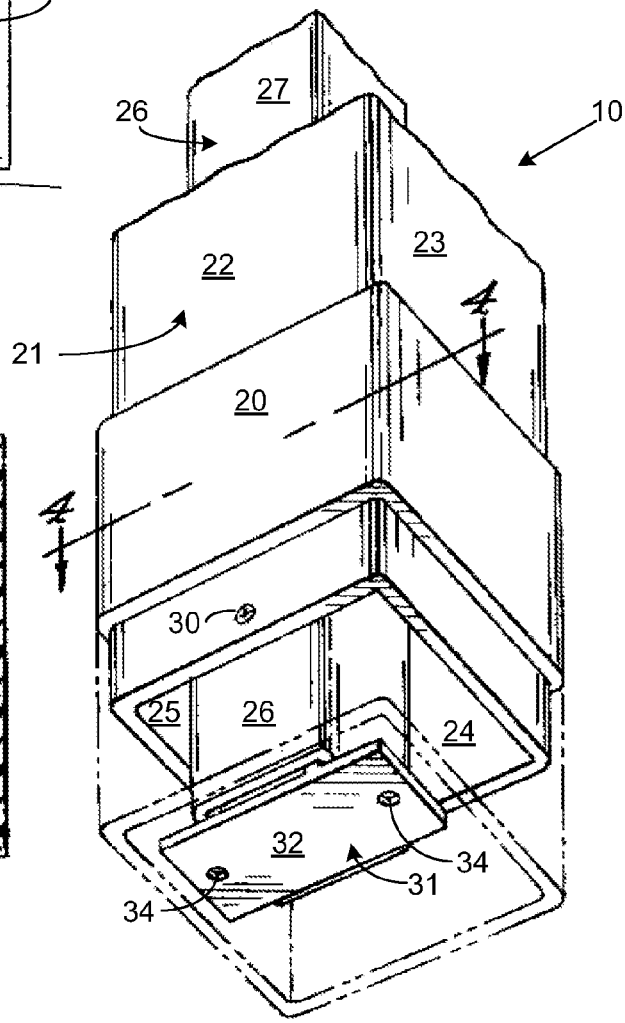
FIG. 3 is a perspective view of one embodiment of a column structure according to the invention.

FIG. 3 illustrates a number of structural features of one embodiment of column according to the invention. The column is again broadly designated at 10. The column includes an exterior shell broadly designated at 21 formed of a plurality of walls (four are illustrated) 22, 23, 24 and 25 that together define an open interior. In exemplary embodiments, the exterior shell is formed of a polymer, with cellular (or "cellular foamed") polyvinyl chloride (PVC) being particularly preferred.

Cellular PVC has a number of favorable characteristics. It can be placed in direct contact with masonry, is moisture resistant, does not need to be painted, and is resistant to insects, rot and weather. It can be handled like wood including cutting, routing, drilling, and nailing. Cellular PVC can be bonded to itself with standard PVC cement or bonded to wood using standard construction adhesives. Cellular foamed PVC is widely commercially available, and is made using processes that are generally well-established in the art (e.g., U.S. Pat. Nos. 3,764,642 and 4,383,812).

Other materials suitable for the exterior shell include wood (e.g., cedar), composite board and solid polymers. As used herein (and generally in the art) "composite board" refers to a consolidated mat of wood materials (such as particles, chips or fibers) typically bound (under heat and pressure) with another material (usually a polymer resin) and often containing a preservative or fungicide such as zinc borate.

An interior load bearing shaft broadly designated at 26 and typically (but not exclusively) formed of metal is positioned within the exterior shell 21. The interior metal shaft 26 is proportionally smaller than the exterior shell 21. One portion of the interior metal shaft 26 is connected against one interior wall of the exterior shell 21 with the remaining portions of the interior shaft 26 being independent of the other interior walls of the exterior shell 21.

In particular, FIGS. 1-4 illustrate a column 10 with a rectangular, and in this case square, exterior shell 21. In this embodiment the metal shaft 26 is also rectangular, is open on its interior, and one wall 27 of the shaft 26 is connected to one wall 22 of the exterior shell. Thus, the shaft 26 is independent of the other interior walls 23, 24 and 25 of the exterior shell 21.

FIG. 3 also illustrates that a screw or rivet 30 provides a straightforward manner of attaching the load bearing metal shaft 26 to the exterior shell 21. In preferred embodiments, the load bearing metal shaft 26 is aluminum because of its light weight, proportional strength, and acceptable cost. Other metals (or other materials of equivalent strength) are, of course, acceptable from a structural standpoint but generally are more expensive, heavier, or have other characteristics that may make them less attractive from a commercial standpoint even though acceptable from a structural standpoint.

FIG. 3 also illustrates that the base 20 of the column 10 is slidingly movable and surrounds portions of the exterior shell 21. It will be understood that the capital 17 can slide in the same manner at the opposite end of the column 10. This provides advantages during installation because the capital 17 and base 20 can be moved to intermediate portions of the column while the column is being installed between the floor 12 and the ceiling 13. The capital 17 and the base 20 can then be moved to their final positions at the respective top and bottom of the column 10 when installation is complete.

Figure 2:
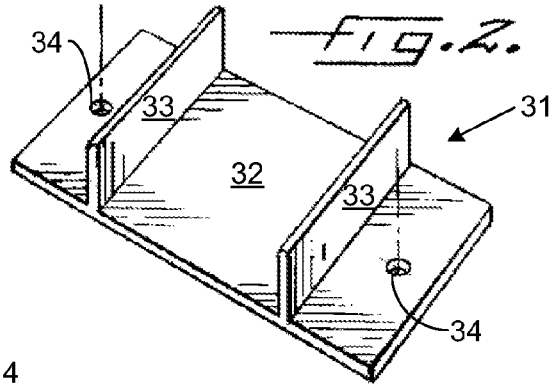
FIG. 2 is a perspective view of a mounting bracket according to the present invention.
Figure 4:
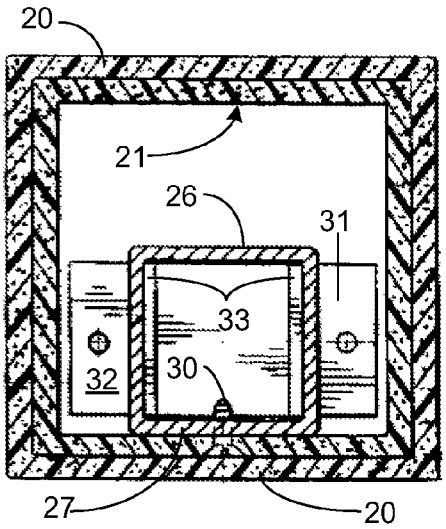
FIG. 4 is a cross-sectional view taken along lines 4-4 of FIG. 3.

FIGS. 2 and 3 also illustrate that the interior metal shaft 26 defines a sleeve into which a mounting bracket broadly designated at 31 in FIGS. 2 and 3 can be inserted. In the embodiment illustrated in FIG. 2, the mounting bracket 31 is formed of respective horizontal 32 and vertical members 33. As illustrated in FIG. 3, the vertical members 33 fit into the sleeve formed by the shaft 26 and the bottom of the shaft 26 (and correspondingly into the top of the shaft for a corresponding top bracket) rests against the horizontal member 32.

The mounting bracket 31 includes a plurality of openings 34 (two are illustrated) to permit screws or nails to fix the bracket 31 to (for example) the floor 12 or the ceiling 13 illustrated in FIG. 1. The combination of the bracket 31 and the metal shaft 26 provides the overall column structure 10 with excellent structural stability and weight-bearing capability, particularly when compared to toe nailing and other techniques often used in decorative columns in a residential or residential-like context.

FIGS. 5 through 8 illustrate a second embodiment of a column according to the present invention broadly designated at 35. In this embodiment the exterior shell 36 of decorative polymer is formed of a plurality of contiguous walls 37, 40, 41 and 42 (e.g., FIG. 8). The contiguous walls together define a base having a first area at one common end of the walls and a capital having a second area at the opposite end of the walls with the capital area being smaller than the base area so that the difference in size between the area of the base and the area of the capital produces a taper longitudinally along the column.

Figure 8:
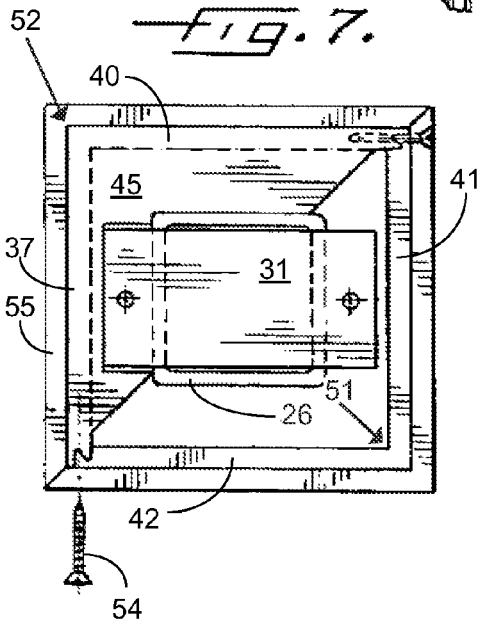
FIG. 8 is a top plan view taken along lines 8-8 of FIG. 6A.

For example, in FIG. 8 the capital area is defined by the four contiguous walls 37, 40, 41 and 42. It will be understood that the base area is defined by the same four walls, but at the opposite end of the column 35.

Figure 5:
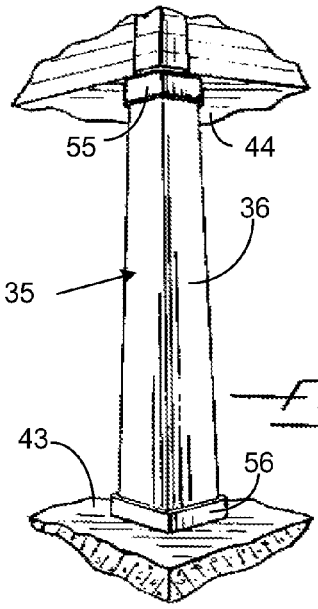
FIG. 5 is a perspective view of another embodiment of a column according to the present invention.

In a manner analogous to FIG. 1, FIG. 5 illustrates the column 35 in the context of a generally horizontal floor 43 and a generally horizontal ceiling (or ceiling beam) 44 that is above and spaced apart from the floor 43. As was the case with FIG. 1, the column 35 can likewise be positioned between a ceiling joist and a floor joist, or between any other equivalent structures.

In this embodiment, the interior load bearing metal shaft is broadly designated at 26 and is surrounded by the decorative exterior shell 36 and spaced from the tapering walls 37, 40, 41 and 42 so that the load bearing shaft 26 and the decorative exterior shell 36 avoid touching one another.

Figure 6A:
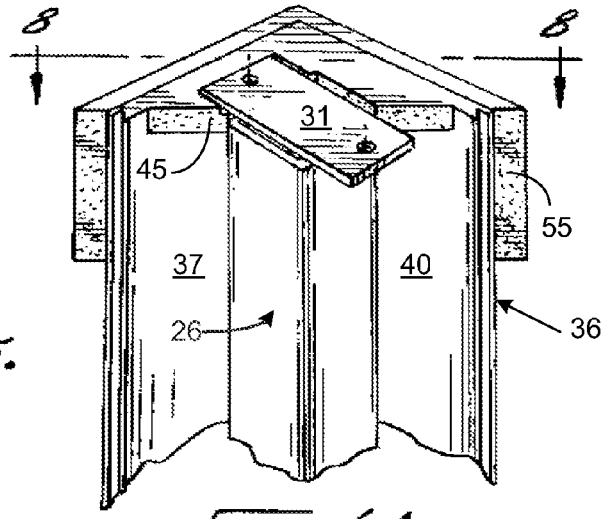
FIGS. 6A and 6B are partial perspective views of portions of the column illustrated in FIG. 5.
Figure 6B:
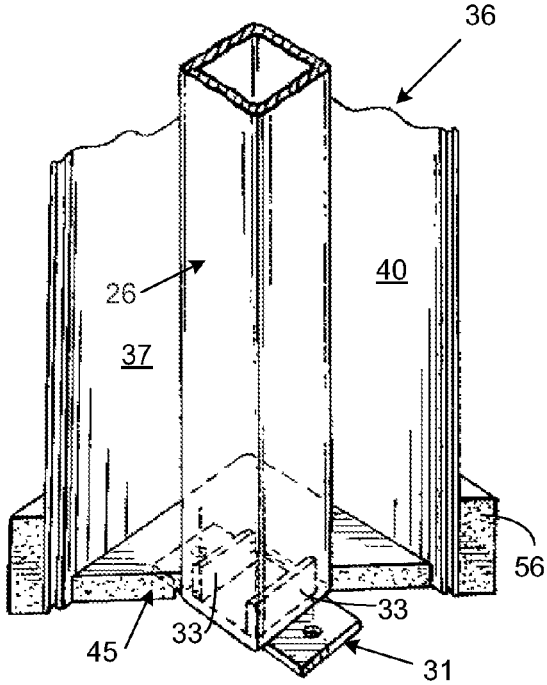

FIG. 6B illustrates a fixture broadly designated at 45 positioned at the base of the column 35 and on the interior of the decorative shell 36. The fixture 45 connects to at least one, but less than all of the contiguous walls 40, 41, 42 and 37 and also connects to the metal shaft 26. As illustrated in FIGS. 6-8, the fixture 45 connects to two of the walls 37 and 40, but not the other two walls 41 and 42.

Figure 7:
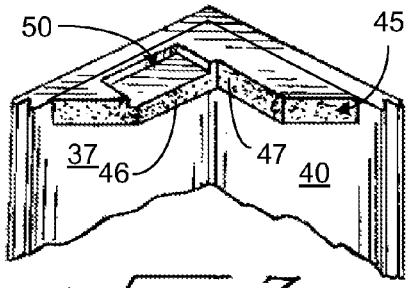
FIG. 7 is a detailed perspective view of a portion of the column structure of FIGS. 5 and 6.

FIGS. 6A, 7 and 8 illustrate a corresponding fixture 45 positioned at the top of the column 35. Both fixtures 45 include a cut out formed of two edges 46 and 47 that are most clearly illustrated in FIG. 7. The cut out defined by the edges 46 and 47 matches a partial profile of the rectangular shaft 26 so that in turn the fixture 45 and the shaft 26 engage one another and the column 35.

Because FIGS. 5 through 8 illustrate an exterior shell 36 with a rectangular (square) cross-section and a metal shaft 43 with a rectangular (square) cross-section, the fixture 45 takes a triangular shape as does the cutout formed by the edges 46 and 47. It will be understood, of course, that other shapes can be used for the column 35 and the shaft 26 and thus for the fixture 45 and the cutout.

FIGS. 5-8 also illustrate the manner in which the column 35 can be mounted using the bracket 31. As in the embodiment illustrated in FIGS. 1-4, the mounting bracket 31 can be inserted into at least one, and typically both, ends of the metal shaft 26. In order to connect the fixture 45, the bracket 31, and a floor 43 or a ceiling 44 in flush, FIG. 7 illustrates that the fixture 45 includes a slot 50 that receives the horizontal member 32 of the mounting bracket 31 when the mounting bracket 31 has been inserted into the shaft 26.

FIG. 8 illustrates that in preferred embodiments, the exterior shell 36 of the tapered column 35 is formed of two complementary portions. A first portion broadly designated at 51 is formed of two of the walls 41 and 42 and a second portion broadly designated at 52 is formed of the other two walls 37 and 40. This structure simplifies the installation of the column 35. As illustrated in FIGS. 6-8, the second shell portion 52 carries the fixture 45 that in turn joins the exterior shell 36 to the interior shaft 26. As a result, the second shell portion 52 can be installed in an environment as illustrated in FIG. 5 with the brackets 31 and the fixtures 45 being easily accessible to the installing worker. In particular, this facilitates mounting the brackets 31 to the floor 43 and the ceiling 44. After the second shell portion 52 has been so installed, the first shell portion 51 can be added (e.g., FIG. 8) to complete the installed structure. A tongue and groove 53 or similar joint can be used along with fasteners illustrated as the screw 54.

FIGS. 5 through 8 also illustrate that the column 35 can include a decorative capital 55 and a decorative base 56. Because the column 35 is tapered, the decorative base 56 can be moved along the column during construction, but the decorative capital 55 will be added last.

In the drawings and specification there has been set forth a preferred embodiment of the invention, and although specific terms have been employed, they are used in a generic and descriptive sense only and not for purposes of limitation, the scope of the invention being defined in the claims.

The invention claimed is:

1. An architectural structure comprising:

a generally horizontal floor;

a generally horizontal beam above and spaced apart from said horizontal floor;

a vertically oriented, substantially hollow load bearing shaft between said floor and said beam and supporting said beam through said shaft and on said horizontal floor;

a tapered exterior shell formed of a plurality of contiguous walls that together define a first opening having a first geometric area at an end adjacent said floor and a second opening having a second geometric area at an opposite end adjacent said beam, wherein said second geometric area is smaller than said first geometric area so that the difference in size between said first geometric area and said second geometric area produces a taper longitudinally along said shell; and a mounting bracket comprising a horizontal member connected to a pair of vertical members, said vertical members engaging oppositely positioned interior surfaces of said hollow load bearing shaft, and said horizontal member extending outside said hollow load bearing shaft and fixed to said floor or said beam.

2. The architectural structure according to claim 1, wherein said exterior shell is selected from the group consisting of cellular PVC, wood, composite board, and solid polymers.

3. The architectural structure according to claim 1, wherein said load bearing shaft comprises aluminum.

4. The architectural structure according to claim 1, further comprising a base fitting around said exterior shell adjacent said floor.

5. The architectural structure according to claim 4, further comprising a capital fitting around said exterior shell adjacent said beam.

6. The architectural structure according to claim 5, said shaft is rectangular, said base fitting is rectangular, and said capital is rectangular.

7. A load bearing architectural column comprising:

an exterior shell comprising connected walls defining a hollow space that tapers in cross sectional area from one end of said shell to an opposite end of said shell;

a load bearing shaft having first and second ends and fitting within said exterior shell;

a mounting bracket removably attached to one of said ends of said load bearing shaft;

a fixture connecting said mounting bracket to said exterior shell wherein said mounting bracket comprises a horizontal member connected to a pair of vertical members, said vertical members engaging oppositely positioned interior surfaces of said load bearing shaft, and wherein said horizontal member extends outside said load bearing shaft and connects to said fixture.

8. The load bearing architectural column according to claim 7, wherein said horizontal member defines openings to connect said mounting bracket to said fixture with fasteners that fit within the openings.

9. The load bearing architectural column according to claim 7, wherein said fixture comprises a substantially triangular perimeter.

10. The load bearing architectural column according to claim 7, wherein said fixture defines a slot for receiving a portion of said mounting bracket when said mounting bracket is inserted into said shaft.

11. The load bearing architectural column according to claim 7, wherein said load bearing shaft comprises aluminum.

12. The load bearing architectural column according to claim 7, further comprising a base fitting around said exterior shell, said base sliding along a length of said exterior shell.

13. A load bearing architectural column comprising:

an exterior shell comprising connected walls defining an open interior that tapers in cross sectional area from one end of said shell to an opposite end of said shell;

a substantially hollow load bearing shaft having first and second ends and fitting within said exterior shell;

a respective mounting bracket removably attached to respective ends of said load bearing shaft;

a respective fixture connecting each mounting bracket to said exterior shell, wherein said fixture defines a perimeter fitting against said exterior shell wherein said mounting bracket comprises a horizontal member connected to a pair of vertical members, said vertical members engaging oppositely positioned interior surfaces of said load bearing shaft, and wherein said horizontal member extends outside said load bearing shaft and connects to said fixture.

14. The load bearing architectural column according to claim 13, wherein said horizontal member defines openings to connect said mounting bracket to said fixture with nails or screws.

15. The load bearing architectural column according to claim 13, wherein said load bearing shaft comprises aluminum.

16. The load bearing architectural column according to claim 13 extending between a floor and a beam, wherein each respective fixture connects to either said floor or said beam.

* * * * *